US005167038A

United States Patent [19]

Rinehart

[11] Patent Number: 5,167,038

[45] Date of Patent: Dec. 1, 1992

[54] LINED GLOVE

[75] Inventor: Dixie L. Rinehart, Aspen, Colo.

[73] Assignee: Rinehart Glove, Ltd., Aspen, Colo.

[21] Appl. No.: 514,797

[22] Filed: Apr. 26, 1990

[51] Int. Cl.[5] ..... A41D 19/00

[52] U.S. Cl. ..... 2/164; 2/163; 2/169

[58] Field of Search ..... 2/163, 164, 159, 169, 2/161 R, 161 A

[56] References Cited

U.S. PATENT DOCUMENTS

| | | | |
|---|---|---|---|
| 550,592 | 12/1895 | Chant | 2/169 X |
| 1,540,718 | 6/1925 | Sturm | 2/163 X |
| 1,666,023 | 4/1928 | Sturm | 2/169 |
| 3,114,915 | 12/1963 | Gross | 2/158 |
| 4,430,759 | 2/1984 | Jackrel | 2/167 X |
| 4,583,248 | 4/1986 | Edwards et al. | 2/164 |
| 4,594,736 | 6/1986 | Connelly | 2/159 X |
| 4,654,896 | 4/1987 | Rinehart | 2/163 |
| 4,831,667 | 5/1989 | Town | 2/169 X |

*Primary Examiner*—Werner H. Schroeder
*Assistant Examiner*—Sara M. Current
*Attorney, Agent, or Firm*—Pennie & Edmonds

[57] ABSTRACT

A lined glove construction having an outer shell and waterproof liner. The liner has all of its dimensions except one, proportioned to the corresponding dimensions of the hand of the wearer. Only the finger lengths of the liner are longer than the proportioned length of the fingers of the wearer. The liner is located in the glove next to the outer shell. Where the glove includes an inner insulation liner, the added length of the finger parts of the liner is correlated to the thickness of the insulation liner.

15 Claims, 4 Drawing Sheets

LINED GLOVE

TECHNICAL FIELD

The present invention relates to a lined glove having an outer shell and a waterproof liner.

BACKGROUND OF THE INVENTION

Various forms of lined glove constructions exist using both the Clute cut and Gunn cut finger patterns. A further example of a glove construction is the fourchette, high fashion type glove. Each of these glove constructions require more than two pattern pieces for forming the finger portions of the glove in order to provide the finger portions with the ability to bend and flex as the fingers of the wearer's hand are bent or flexed.

Another type of glove construction is disclosed in applicant's U.S. Pat. No. 4,654,896, granted Apr. 7, 1987. In accordance with this patent, the finger portion of the glove, or liner, is constructed of two superimposed four-pointed, star-shaped pattern pieces each having a cutout facilitating joining of the finger parts to each other while the two pieces are laid in flat superimposed relationship. With this construction, the finger portion can also be secured to the palm and back parts of the glove along a generally straight line and also while the pieces of material are laid in flat position overlying each other.

In any of the glove constructions described above, it is sometimes desirable to provide a waterproof insert member or liner to protect the wearer's hand against moisture. Generally, very thin materials are used to fabricate the liner so as to keep the bulk and stiffness of the liner and the overall glove to a minimum. Rubber and plastic-dipped waterproof liners are not generally acceptable, as they are too stiff and bulky; and as such, adversely affect the dexterity and mobility of the entire glove assembly.

Materials suitable for waterproof liners presently used in glove constructions include relatively inelastic thin, pliable plastic films, such as breathable microporous polyurethanes. An example of such a material is one sold under the name Gore-Tex, a trademark owned by W. L. Gore and Associates Inc. Other microporous plastic films having similar characteristics are also suitable for liners, either alone or as a laminated construction bonded to other materials, for example, thin stretch nylon fabric. In assembling these materials into a liner, they are heat sealed, or the seams are sealed with waterproof tapes. Stitching is generally avoided as it produces holes in the material which requires further sealing.

Waterproof/breathable liners can be used either alone with the outer shell of the glove or in glove constructions which include a further insulation liner. In the latter construction, the liner is disposed between the outer shell and the inner insulation liner. In both situations it is necessary that the liner have sufficient size so as not to adversely affect the dexterity, mobility and tactility of the total glove system. Bending of the wearer's hand within the glove requires that the liner, as well as the other parts of the glove, have sufficient length so as to accommodate the bending of the fingers at the knuckle joints without binding of the layers during such movement of the hand.

Prior art waterproof liners described above are formed from pattern pieces which are superimposed on one another and laid flat during the joining of the pieces by a heat sealing operation. This flat joining is done so as to avoid complicated manufacturing techniques during the heat sealing step. However, with the prior art techniques of sealing in the flat, the pattern pieces are generally made oversized in all respects relative to the dimensions of the wearer's hand. In particular, in order to provide the required material to cover the width and circumference of the four fingers of the hand, the geometry of the hand portion below the junction of each fingers with the palm part of the liner must be patterned to an oversized dimension if the pattern pieces are to be sealed in the flat. This oversized dimension is generally equal to the sum of the combined widths of the finger parts of the liner; and inherently provides more material than required for the width of the hand immediately below the junction of the finger parts with the palm part. This results in increased bulk, additional material usage and a non-conforming fit to the hand. Prior art constructions of this type decrease mobility, dexterity, tactility and neat uniform fit of the glove.

Also, with the techniques of applicant's prior U.S. Pat. No. 4,654,896 used to construct a liner for a glove, the process requires pattern pieces of unequal shape and the formation of tucks in the finger parts of the liner to provide for flexing of the wearer's fingers. This additional length and tucking not only adds to the expense, but complicates the manufacturing process in that thin liner material is difficult to handle and difficult to properly seal where the material is layered along the length of the seal line and thus, of varying thickness, as would be the case in the area of the tucks.

SUMMARY OF THE INVENTION

In accordance with the teachings of the present invention, the lined glove includes a waterproof/breathable liner constructed with all dimensions, except one, proportioned to the corresponding dimensions of the hand of the wearer. This one dimension which is out of proportion to the dimension of the wearer's hand, is the finger length of the finger parts of the liner. The lengths are longer in proportion to the length of the individual's fingers so as to accommodate flexing and bending of the fingers. Unlike the prior art construction of applicant's U.S. Pat. No. 4,654,896 where pattern pieces of unequal shape are used and the assembled finger lengths of the liner, with tucks, are proportioned to the finger lengths of the wearer's hand, the finger parts of the liner of the present invention are constructed from pattern pieces of equal shape and with no tucking. Also, although the prior art liner constructions using the same thin materials includes finger parts which are longer in proportion to the length of the individual's fingers, such prior art constructions, as described above, are not otherwise totally dimensioned in proportion to the user's hand. With applicant's proper dimensioning of the other dimensions, the liner has a minimum bulk and provides a proper fit. This results in a glove with improved mobility, dexterity and tactility. The liner also improves the donning and doffing of the glove by the wearer due to its reduced internal bulk and generally conforming fit to the wearer's hand.

In accordance with the teachings of the present invention, the liner is constructed of two superimposed four-pointed, star-shaped pattern pieces of identical shape for forming the finger portion of the glove. Each pattern piece is, with one basic exception, formed and connected to the other in generally the same manner as disclosed in applicant's prior U.S. Pat. No. 4,654,896. This patent is incorporated herein by reference. In the construction on the '896 patent, the finger pieces are made of unequal length with the longer piece folded into a transverse tuck so as to accommodate flexing and bending of the individual's fingers. In the liner construction of the present invention, the two pattern pieces of material making up each finger part are of equal, rather than unequal, length and longer than the proportioned finger length of the individual's hand. Although the additional length of the finger parts would normally provide a sloppy fit on the user's hand if used as an outer glove shell, the excess material which provides this added length automatically locates itself over the finger knuckle joints when used as a liner inside the outer shell of a glove. This added length is particularly well accommodated in an outer shell construction having finger parts constructed precisely according to the teaching of my referenced U.S. Pat. No. 4,654,896. In particular, the excess material of the back sides of the finger parts of the liner is accommodated in the folded area of each finger part of the outer shell and generally remains there during wearing of the glove and during donning and doffing of the glove.

DESCRIPTION OF THE PREFERRED EMBODIMENTS

Figure 1:
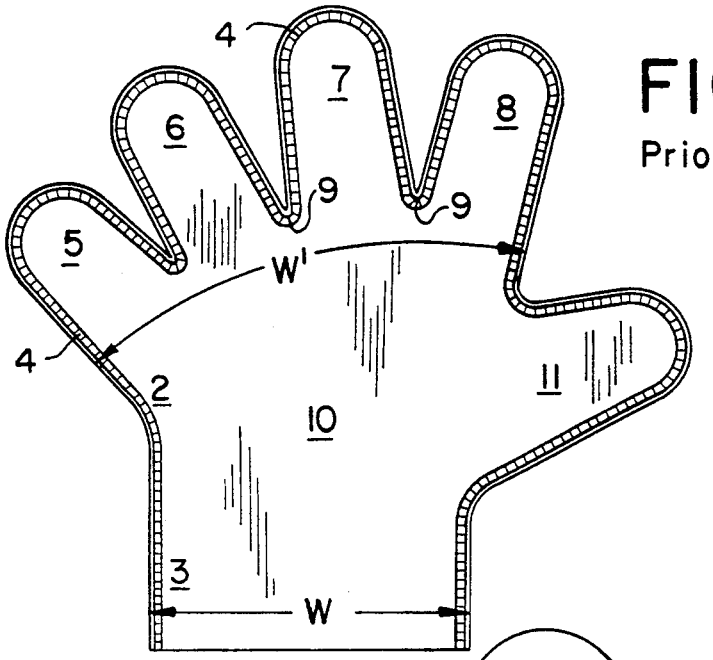
FIG. 1 Prior Art
FIG. 1 is a plan view of a heat sealed liner constructed according to the teachings of the prior art.

FIG. 1 shows a plan view of a liner constructed according to the prior art. This liner 1 which may be of generally inelastic thin microporous polyurethane is both waterproof and breathable. It is constructed by superimposing two pattern pieces 2, 3 and heat sealing them together along the seal line 4. This heat sealing is done while the pieces are held in flat superimposed relationship. It is advantageous to be able to secure the pieces together in flat condition as this makes the assembly of the liner less complicated. With this prior art construction, the width of each finger part 5, 6, 7 and 8 is proportioned to the width of the individual fingers of the wearer. As with applicant's invention, this proportioning also accounts for the circumference of each finger as obviously the two sealed materials must be able to spread apart from each other to accommodate the individual's fingers. The particular waterproof liner structure shown in FIG. 1 is typically used in a glove comprised of an outer shell part and an inner insulation liner. The liner of FIG. 1 will be inserted between the outer shell and the insulation liner and is thus also dimensioned so as to accommodate the insulation liner, as well as the individual's hand.

The length of each of the fingers in the prior art liner is generally longer than the proportioned length of the fingers of the individual's hand. This length L as shown for finger 7 is measured from the junction 9 of the finger at the palm part 10 of the liner to the seal line 4 at the tip of the finger. The added length of the finer part beyond that which is proportional to the length of the finger of the wearer's hand is sufficient to permit flexing of the fingers and the inner insulation liner, where one is used.

Finally, the liner construction of the prior art as shown in FIG. 1 also includes a thumb part 11. Below the thumb part, the liner has a width W which is generally proportioned to the width of the hand of the user at a location just below the thumb.

A significant problem with the liner construction of the prior art as shown in FIG. 1 is that the dimension of the width of the liner just below the junction 9 of the finger parts with the palm part 10 of the liner is greatly oversized in proportion to the width of the user's hand along this area. As shown in FIG. 1, this width W' about equals the sum of the widths of the individual fingers 5, 6, 7 and 8. The added length of the width W' is necessary with the prior art construction in order to be able to seal the two pattern pieces 2 and 3 together while in flat condition.

Compared to the width of the individual's hand below the junction of the fingers with the palm, the added length of the width W' of the liner is about equal to the width of one finger. This is readily appreciated when looking at one's own hand and observing that the width across the hand just below the junction of the fingers and above the junction of the thumb with the palm part is about equal to the width of the hand just below the thumb.

The excess material required in the prior art construction must be accommodated inside the glove shell. The glove shell however generally has a configuration in which all of the width dimensions are properly proportioned to the corresponding width dimensions of the individual's hand. This excess liner material not only results in a non-conforming liner shape, but also requires unnecessary additional material for forming the liner.

Figure 2:
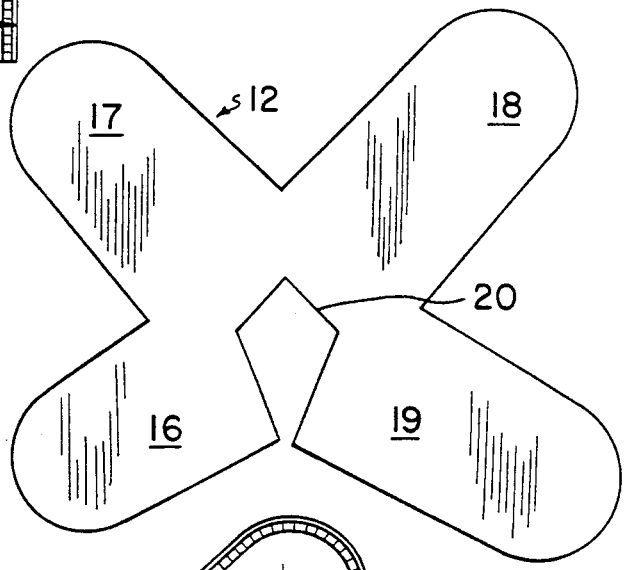
FIG. 2 is a plan view of a finger pattern piece forming the back side of the finger portion of the liner, constructed according to the teachings of the present invention.
Figure 3:
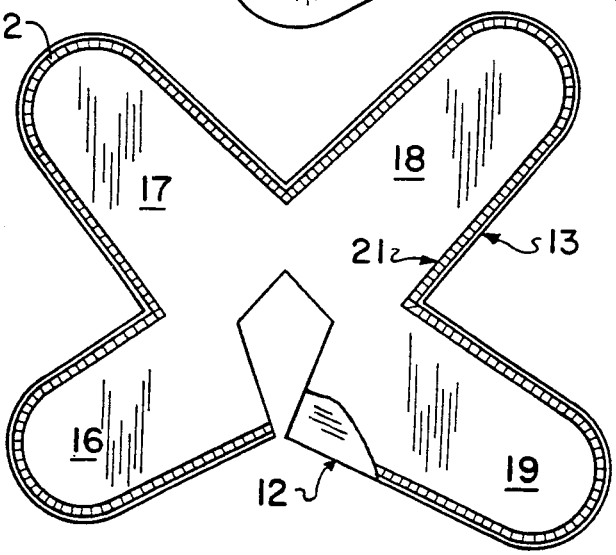
FIG. 3 is a plan view of a pattern piece forming the palm side of the finger portion of the liner disposed over the back side and sealed thereto about their outer peripheries.

In accordance with the teachings of the present invention, the glove liner is constructed of the same material as in the prior art liners but includes a finger portion constructed of two superimposed, heat sealable, flat, four-pointed, star-shaped finger pattern pieces 12 and 13. Each point of the star defines a finger part 16, 17, 18 and 19 and each piece has an inner cutout 20 and 21 of rectangular shape. FIG. 2 shows the pattern piece for the back side of the finger portion of the liner whereas FIG. 3 shows the pattern piece for the palm side of the finger portion superimposed over the back side and heat sealed thereto about its outer periphery as shown by the heat seal line 22. The seal line 22 is spaced inwardly from the edges of the pattern pieces to assure complete sealing and for attachment purposes as described more fully below. As is evident from FIG. 3, the two pattern pieces are of identical shape.

Figure 4:
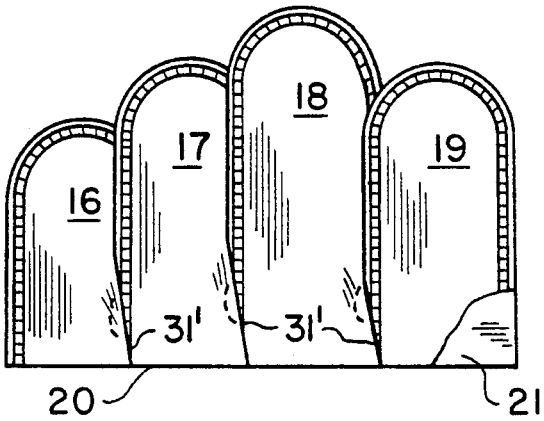
FIG. 4 is a plan view of the finger portion of the liner of FIG. 3 oriented for connection to the palm and back parts of the liner.
Figure 5:
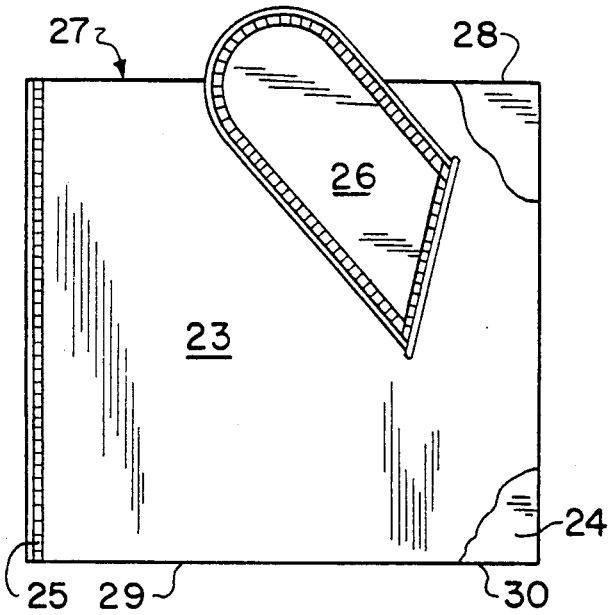
FIG. 5 is a plan view of the palm part of the liner, partly broken away to show the back part.
Figure 6:
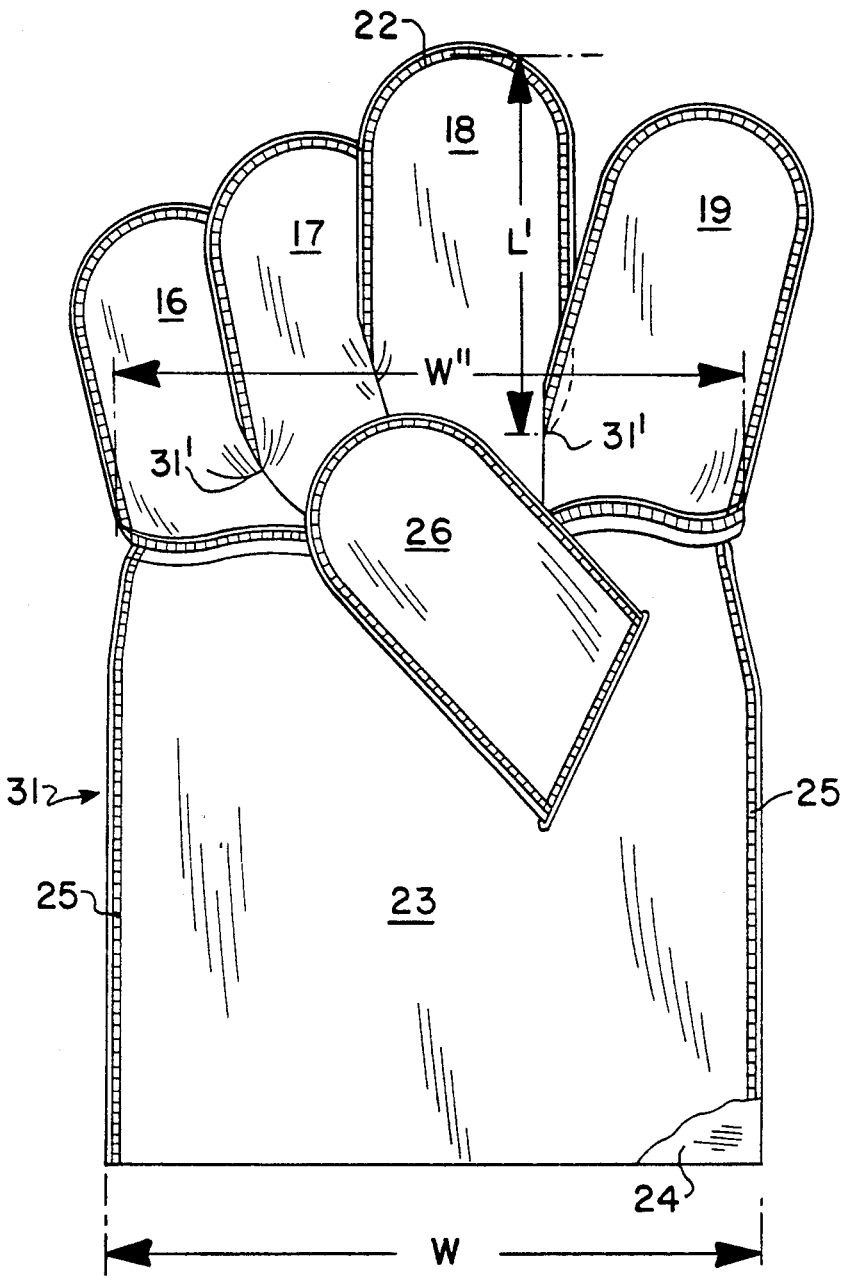
FIG. 6 is a plan view of the finger portion of the liner joined to the palm and back part of the liner.

After assembly of the finger portion of the liner, it is then manipulated into the orientation shown in FIG. 4 to position the edges of the cutouts 20 and 21 along overlying straight base lines. It is then heat sealed to the palm and back parts 23, 24 of the liner, shown in FIG. 5. The palm and back parts 23, 24 are themselves heat sealed together along their sides as shown at 25 to form a tube shape having a thumb 26, open upper superimposed edges 27, 28 and open lower edges 29, 30. In the completed liner 31 as shown in FIG. 6, the assembled finger portion of FIG. 4 is joined to the assembled palm and back parts of FIG. 5 along generally straight base lines of sealing. In particular, the straightened cutout edge 21 of the front side of the finger portion is heat sealed along the upper edge 27 of the palm part 23, while the straightened cutout edge 20 of the back side of the finger portion of the liner is heat sealed along the edge 28 of the back part of the liner. The materials are overlapped for this sealing and the sealing is spaced from the free edges to assure proper sealing.

The construction and assembly of the liner 31 is generally in accordance with applicant's prior U.S. Pat. No. 4,654,896, which patent is incorporated herein by reference. In particular, reference is made to the description of the prior patent as set out in columns 4 and 5. The present construction differs from that disclosed in the earlier patent in that the two pieces are heat sealed together rather than sewn and in that the finger parts 16–19 of the pattern pieces 12 and 13 are both of equal length but longer than the proportioned length of the fingers of the individual hand. The length L' of each finger is measured from the seal line 22 at the tip of each finger to the junction 31' of the finger with the palm part of the liner. In both constructions however, the width of the liner at the base line location just below the junction 31' of the finger parts with the palm and back parts of the liner and above the junction of the thumb is properly proportioned to the corresponding width of the wearer's hand. This is readily apparent from FIG. 6 where this width W'' is shown. As further evident from FIG. 6, the width W'' is generally the same as the width W of the liner just below the thumb. This width W is also about equal to the width W of the prior art construction of FIG. 1. Thus the liner shown in FIG. 6 has, except for the finger lengths, all of its dimensions proportioned to the corresponding dimensions of the wearer's hand. The added length of the finger parts accommodate the bending of the fingers of the wearer about the finger joints, but this added length does not require any added width in the liner in the area below the fingers as is necessary with the prior art.

Figure 7:
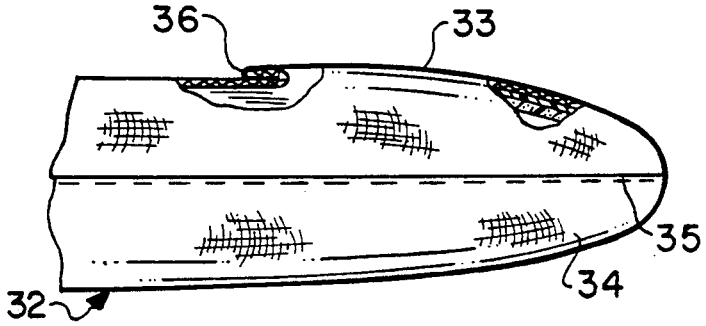
FIG. 7 is an enlarged side view, partly in cross-section, of a finger of the outer shell of the glove of the present invention.

FIG. 7 shows the outer shell 32 of the glove in which the liner of FIGS. 1–6 is incorporated. This outer shell is preferably constructed precisely according to the teachings of applicant's prior U.S. Pat. No. 4,654,896, which as stated above is incorporated herein by reference. Reference is made to this earlier patent for a full description of the preferred shell construction of the lined glove of the present invention. The finger portion of the shell shown in FIG. 7 includes a back side 33 of longer length than the palm side 34 of the finger part, the two sides being joined together at 35 along side lines of non-extension of the finger part. The excess length of the back side of the finger part is formed into a tuck 36 comprising a portion of the back side folded upon itself. The fold is secured only along the ends thereof, that is, along the line 35 of joining of the back and palm sides of the finger part.

Figure 8:
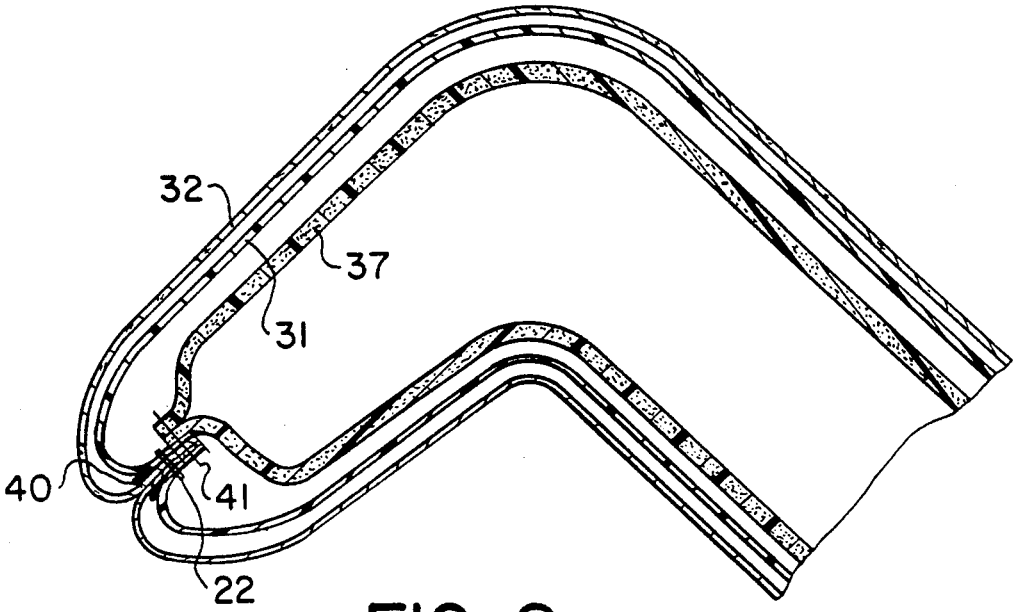
FIG. 8 is a cross-sectional view through one finger part of the glove with the liner constructed according to the teachings of the present invention and used in conjunction with an inner insulation liner.

In the construction shown in FIG. 8, the liner 31 is incorporated into the outer shell 32 of the glove which includes an inner insulation liner 37. The waterproof liner 31 is disposed between the outer shell 32 and the inner insulation liner 37 to keep the insulation liner as well as the wearer's hand dry. The liner is, as described above, constructed of generally inelastic microporous polyurethane. It's thickness is between about 2 and 4 mils. With the construction of FIG. 8 incorporating an inner insulation liner, the length of the finger parts of the liner 32 are correlated to the thickness of the insulation liner. In particular, the added length of the finger parts beyond the proportioned length of the fingers of the wearer's hand ranges from about ¼ of an inch for an insulation liner having a thickness of about ⅛ of an inch, ½ an inch of added length for an insulation liner of ¼ inch thickness and ¾ of an inch added length for an insulation liner having a thickness of about ½ inch. This added length is sufficient to accommodate bending of the finger joints as well as the underlying insulation liner.

Figure 9:
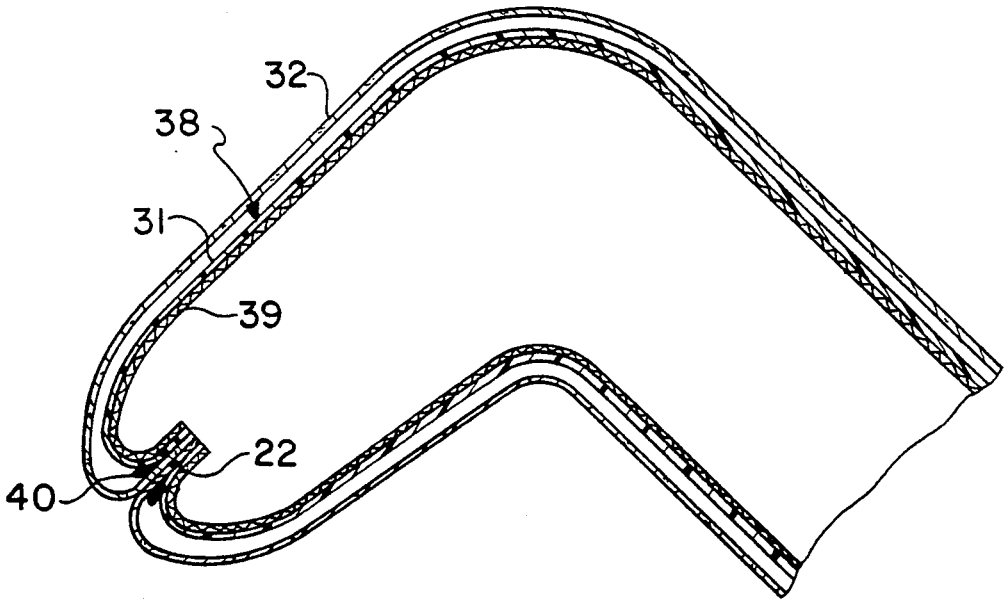
FIG. 9 is a cross-sectional view similar to FIG. 4, showing the glove with a laminated liner and without any insulation liner.

FIG. 9 shows a glove construction including an outer shell 32 and a liner 38. This glove includes no insulation liner. The liner 38 is of similar construction to the liner 31 of FIG. 8 in that it includes a microporous plastic film. In addition, however, a stretch nylon fabric 39 is laminated to the film 31. The plastic film has a thickness of between about 1 and 2 mils, whereas the nylon fabric has a thickness of about 2 mils. The laminated liner construction of FIG. 9 can be used in a glove construction which includes an inner insulation liner. Also, a glove construction without an insulation liner can use the single thickness liner 31 of FIG. 8. When the waterproof liners, as described above, are used in a glove without an insulation liner, the added length of the finger parts beyond the proportioned length of the fingers of the wearer is about ⅛ inch.

In both of the constructions shown in FIGS. 8 and 9, the liner 31 is connected to the outer shell 32 at the tips of each of the fingers. This is done by bonding the two together with a cement 40, such as the silicone cement. This attachment prevents the liner from being pulled out of the glove when it is taken off the wearer's hand.

Where the glove includes an insulation liner 37 as shown in FIG. 8, the liner 31 is attached to the insulation liner 37 by sewing as shown at 41. For this purpose, the intermediate waterproof liner 31, after formation, is turned inside out so that the tip free edges of the fingers beyond the seal line 22 face the internal insulation liner 37. The stitching of the waterproof liner 31 to the insulation liner 37 is effected at a location outside of the seal line 22 so as not to destroy the waterproofness of the liner 31.

I claim:

1. In a lined glove construction having an outer shell and a waterproof liner disposed therein, the improvement characterized in that:

a) the waterproof liner includes:

i) two superimposed heat sealable flat, four-pointed star-shaped finger pattern pieces each having an inner cutout therein with said pieces being heat sealed together about their outer peripheries to form the back side and the palm side of finger parts of the liner;

ii) superimposed back and palm parts having a width dimensioned in proportion to the width of the back and palm parts of the hand of the intended wearer, said back and palm parts being heat sealed together along the sides thereof to form a tube shape having open upper and lower superimposed edges;

b) said finger pattern pieces are arranged with the edges of the cutouts of the superimposed pieces lying along a base line and heat sealed along said base line to the open upper edges of the back and palm parts of the liner to form a completed liner;

c) said finger parts of the liner each have a width proportioned to the width of the fingers of the hand of the intended wearer and an added length out of proportion to the length of the fingers of the hand of the intended wearer, said added length being sufficient to accommodate the bending of the fingers of the wearer about the finger joints; and d) the width of the finger pattern piece along the base line of the finger pattern pieces is dimensioned in proportion to the width of the hand of the wearer along an area of the hand below the junction of the fingers with the palm and above the junction of the thumb with the palm.

2. The lined glove according to claim 1 wherein:

a) the length of the back and palm sides of each finger part of the liner are equal to each other.

3. The lined glove according to claim 2 wherein:

a) the liner includes an inelastic micro-porous plastic film of a thickness between about 1 and 4 mils.

4. In a lined glove construction having an outer shell with an inner insulation liner and an intermediate waterproof liner disposed therein, with the intermediate waterproof liner located between the shell and the insulation liner, the improvement characterized in that:

a) the intermediate waterproof liner includes:

i) two superimposed heat sealable flat, four-pointed star-shaped finger pattern pieces each having an inner cutout therein with said pieces being heat sealed together about their outer peripheries to form the back side and the palm side of finger parts of the liner;

ii) superimposed back and palm parts having a width dimensioned in proportion to the width of the back and palm parts of the hand of the intended wearer, said back and palm parts being heat sealed together along the sides thereof to form a tube shape having open upper and lower superimposed edges;

b) said finger pattern pieces are arranged with the edges of the cutouts of the superimposed pieces lying along a base line and heat sealed along said base line to the open upper edges of the back and palm parts of the liner to form a completed liner;

c) said finger parts of the liner each have a width proportioned to the width of the fingers of the hand of the intended wearer and an added length out of proportion to the length of the fingers of the hand of the intended wearer, said added length being sufficient to accommodate the bending of the fingers of the wearer about the finger joints; and d) the width of the finger pattern piece along the base line of the finger pattern pieces is dimensioned in proportion to the width of the hand of the wearer along an area of the hand below the junction of the fingers with the palm and above the junction of the thumb with the palm.

5. The lined glove according to claim 4 wherein:

a) the intermediate waterproof liner includes an inelastic micro-porous plastic film.

6. The lined glove according to claim 5 wherein:

a) the intermediate waterproof liner is a polyurethane plastic.

7. The lined glove according to claim 4 wherein:

a) the insulation liner has a predetermined thickness;

b) the intermediate waterproof liner has a thickness between about 2 and 4 mils; and c) the added length of the intermediate waterproof liner is greater than the thickness of the insulation liner.

8. The lined glove according to claim 7 wherein:

a) the thickness of the insulation liner is between about $\frac{1}{8}''$ and $\frac{1}{2}''$; and b) the added length of the intermediate waterproof liner ranges between about $\frac{1}{4}''$ with the $\frac{1}{8}''$ thick insulation liner to $\frac{3}{4}''$ with the $\frac{1}{2}''$ insulation liner.

9. The lined glove according to claim 4 wherein:

a) the sealing of the finger parts of the waterproof liner is spaced inwardly from the outer peripheries of the pattern pieces forming free edges;

b) the waterproof liner is disposed in the outer shell of the glove with the liner turned inside out whereby the free edges of the finger parts are inside the liner; and c) the waterproof liner is connected to the insulation liner at a location between the seal line and free edges of the finger parts of the waterproof liner.

10. The lined glove according to any one of claims 4–9 wherein:

a) the intermediate waterproof liner is a microporous polyurethane plastic having a thickness between about 2 and 4 mils.

11. The lined glove according to any one of claims 4–9 wherein:

a) the intermediate waterproof liner is a laminate construction comprising a micro-porous plastic film having a thickness between about 1 and 2 mils and a nylon fabric having a thickness of about 2 mils.

12. The lined glove according to any one of claims 1–9 wherein:

a) the outer shell is constructed with a finger portion having a back part and a palm part defining the back side and palm side, respectively, of finger parts of the finger portion with the back side of each finger part of the finger portion being of longer material length than palm side thereof and joined together with the back side shortened to the length of the palm side by at least one tuck therein extending across its width.

13. The lined glove according to claim 12 wherein:

a) each of said tucks comprises a portion of the back side of the finger part folded upon itself with the fold secured only at the outer side peripheries of the finger part.

14. The lined glove according to claim 13 wherein:

a) the finger portion of the outer shell includes two superimposed four-pointed star-shaped pattern pieces each having an inner cutout therein with the pieces being joined together about their outer peripheries to form the back side and palm side of the finger parts of the outer shell.

15. The lined glove according to claim 14 wherein:

a) the edge of the cutout of the pattern piece forming the palm side of both the outer shell and the waterproof liner is joined in a substantially straight line configuration to an edge of a palm part of the shell and liner and in that the edge of the cutout of the pattern piece forming the back side of both the outer shell and the waterproof liner is joined in a substantially straight line configuration to the edge of a back part of the shell and liner.

* * * * *